US005101905A

United States Patent [19]

Arlt et al.

[11] Patent Number: 5,101,905

[45] Date of Patent: Apr. 7, 1992

[54] RISER TENSIONER SYSTEM FOR USE ON OFFSHORE PLATFORMS

[75] Inventors: Edward J. Arlt, Ft. Worth; Charles J. Moses, Alvarado, both of Tex.

[73] Assignee: LTV Energy Products Company, Garland, Tex.

[21] Appl. No.: 661,461

[22] Filed: Feb. 26, 1991

[51] Int. Cl.[5] ..... E21B 19/09

[52] U.S. Cl. ..... 166/350; 166/355; 166/367; 175/7; 254/392

[58] Field of Search ..... 175/7; 166/345, 350, 166/355, 367; 405/195, 224; 254/277, 392, 900

[56] References Cited

U.S. PATENT DOCUMENTS

| | | | |
|---|---|---|---|
| 2,343,839 | 3/1944 | Austin . | |
| 2,588,158 | 3/1952 | Pierce . | |
| 2,616,273 | 11/1952 | Pringle . | |
| 2,737,362 | 3/1956 | Krone et al. . | |
| 2,739,778 | 3/1956 | Krone et al. . | |
| 3,120,745 | 2/1964 | Saurer . | |
| 3,636,729 | 1/1972 | Patel . | |
| 3,902,333 | 9/1975 | Dossier . | |
| 4,142,584 | 3/1979 | Brewer et al. | 175/7 X |
| 4,272,059 | 6/1981 | Noerager et al. . | |
| 4,423,983 | 1/1984 | Nickiforos et al. . | |
| 4,456,073 | 6/1984 | Barth et al. | 166/355 X |
| 4,537,233 | 8/1985 | Vroonland et al. . | |
| 4,616,708 | 10/1986 | da Mota | 175/7 X |
| 4,617,998 | 10/1986 | Langner . | |
| 4,627,885 | 12/1986 | Arlt . | |
| 4,655,433 | 4/1987 | Peppel . | |
| 4,728,224 | 3/1988 | Salama et al. . | |
| 4,729,694 | 3/1988 | Peppel . | |
| 4,759,662 | 7/1988 | Peppel . | |
| 4,846,446 | 7/1989 | Peppel et al. . | |
| 4,883,387 | 11/1989 | Myers et al. | 166/367 X |
| 4,892,444 | 1/1990 | Moore | 166/350 X |

*Primary Examiner*—William P. Neuder

*Attorney, Agent, or Firm*—Arnold, White & Durkee

[57] ABSTRACT

A riser tensioner system 10 includes a pair of supports 14, 16 affixed to an offshore platform in spaced apart relation to one another. A shaft 24 extends between the supports 14, 16 and is pivotally coupled thereto by an elastomeric bearing 26. A central support 22 is pivotally coupled to the shaft 24 at about the midpoint between the supports 14, 16 and fixedly coupled to coil springs 30 or elastomeric springs 100 coaxially arranged about the shaft 24 and extending between the central support 22 and each of the supports 14, 16. The central support 22 is also coupled to a riser 12 so that relative movement between the offshore platform and the riser 12 causes the central support 22 to pivot on the shaft 24 and wind or unwind the coil springs 30 or elastomeric springs 100 for relative upward and downward movement thereof. A pretensioner mechanism 42 increases the force exerted by the springs 30 or elastomeric springs 100 to increase the upward force applied to the riser 12. In this manner, the riser tensioner system 10 fully supports the riser 12 while allowing relative vertical movement therebetween.

22 Claims, 6 Drawing Sheets

RISER TENSIONER SYSTEM FOR USE ON OFFSHORE PLATFORMS

BACKGROUND OF THE INVENTION

1. Field of the Invention

This invention relates generally to riser tensioner systems for use on offshore platforms and, more particularly, to a riser tensioner system that utilizes a torsion spring to absorb oscillatory, vertical movement of the platform while supporting the riser.

2. Description of the Related Art

Increased oil consumption has led to exploration and drilling in difficult geographic locations that were previously considered to be economically unfeasible. As is to be expected, drilling under these difficult conditions leads to problems that are not present under more ideal conditions. For example, an increasing number of exploratory wells are being drilled in deep water, offshore locations in an attempt to locate more oil and gas reservoirs. These exploratory wells are generally drilled from floating vessels, leading to a set of problems peculiar to that environment.

As in any drilling operation, offshore drilling requires that drilling fluid must be circulated through the drill bit to cool the bit and to carry away the cuttings. This drilling fluid is normally delivered to the drill bit through the drill string and returned to the floating vessel through an annulus formed between the drill string and a large diameter pipe, commonly known as a riser. The riser typically extends between a subsea wellhead assembly and the floating vessel and is sealed against water intrusion.

The lower end of this riser is connected to the wellhead assembly adjacent the ocean floor, and the upper end usually extends through a centrally located opening in the hull of the floating vessel. The drill string extends longitudinally through the riser and into earth formations lying below the body of water, and drilling fluid circulates downwardly through the drill string, out through the drill bit, and then upwardly through the annular space between the drill string and the riser, returning to the vessel.

As these drilling operations progress into deeper waters, the length of the riser and, consequently, its unsupported weight also increases. Riser structural failure may result if compressive stresses in the elements of the riser exceed the metallurgical limitations of the riser material. Riser tensioning systems are typically used to avoid of this type of riser failure.

Riser tensioning systems are installed onboard the vessel, and apply an upward force to the upper end of the riser, usually by means of cable, sheave, and pneumatic cylinder mechanisms connected between the vessel and the upper end of the riser.

In addition, buoyancy or ballasting elements may also be attached to the submerged portion of the riser. These usually are comprised of syntactic foam elements or individual ballast or buoyancy tanks formed on the outer surface of the riser sections. The ballast or buoyancy tanks are capable of being selectively inflated with air or ballasted with water by using the floating vessel's air compression equipment. These buoyancy devices create upwardly directed forces in the riser, and, thereby, compensate for the compressive stresses created by the riser's weight.

Both types of these mechanisms suffer from inherent disadvantages. Hydraulic and pneumatic tensioning systems are large, heavy, and require extensive support equipment, such as, air compressors, hydraulic fluid, reservoirs, piping, valves, pumps, accumulators, electrical power, and control systems. The complexity of these systems necessitate extensive and frequent maintenance with their attendant high cost.

The present invention is directed to overcoming or minimizing one or more of the problems set forth above.

SUMMARY OF THE INVENTION

In one aspect of the present invention, a riser tensioner system is provided for mounting between a floating platform and a riser, and for applying a generally upward force to the riser while allowing limited vertical movement therebetween. The riser tensioner system includes first and second spaced apart supports adapted for being supported relative to the floating platform. A shaft is coupled to each of the first and second supports and extends therebetween. A central support has a first end portion coupled to the shaft between the first and second supports and a second end portion adapted for being coupled to the riser. A torsion spring has a first end portion coupled to one of the first and second supports and a second end portion coupled to the central support whereby the spring urges the central support to rotate about the shaft and force the riser generally upward to support the riser. Finally, the riser tensioner system includes pretensioning means for applying a bias to the torsion spring whereby the force applied to the central support and riser is enhanced.

In another aspect of the present invention, a riser tensioner system is provided for mounting between a floating platform and a riser, and for applying a generally upward force to the riser while allowing limited vertical movement therebetween. The riser tensioner system includes first and second spaced apart supports adapted for being supported relative to said platform in spaced-apart relation. A shaft is pivotally coupled to each of said first and second supports and extends therebetween. A central support has a first end portion coupled to said shaft between said first and second supports and a second end portion adapted for being coupled to said riser. A metallic coil spring is coaxially positioned about said shaft and has a first end portion coupled to one of said first and second supports and a second end portion coupled to said central support whereby said metallic coil spring urges said central support to rotate about said shaft and force said riser generally upward to support said riser. Finally, the riser tensioner system includes pretensioning means for applying a bias to said metallic coil spring whereby the force applied to the central support and riser is enhanced.

In yet another aspect of the present invention, a riser tensioner system is provided for mounting between a floating platform and a riser, and for applying a generally upward force to the riser while allowing limited vertical movement therebetween. The riser tensioner system includes first and second spaced apart supports adapted for being supported relative to said platform in spaced-apart relation. A shaft is coupled to each of said first and second supports and extends therebetween. A central support has a first end portion coupled to said shaft between said first and second supports and a second end portion adapted for being coupleed to said riser. An elastomeric spring is coaxially positioned about said shaft and has a first end portion coupled to one of said first and second supports and a second end portion coupleed to said central support whereby said elastomeric spring urges said central support to rotate about said shaft and force said riser generally upward to support said riser. Finally, the riser tensioner system includes pretensioning means for applying a bias to said elastomeric spring whereby the force applied to the central support and riser is enhanced.

BRIEF DESCRIPTION OF THE DRAWINGS

Other objects and advantages of the invention will become apparent upon reading the following detailed description and upon reference to the drawings in which.

Figure 1:
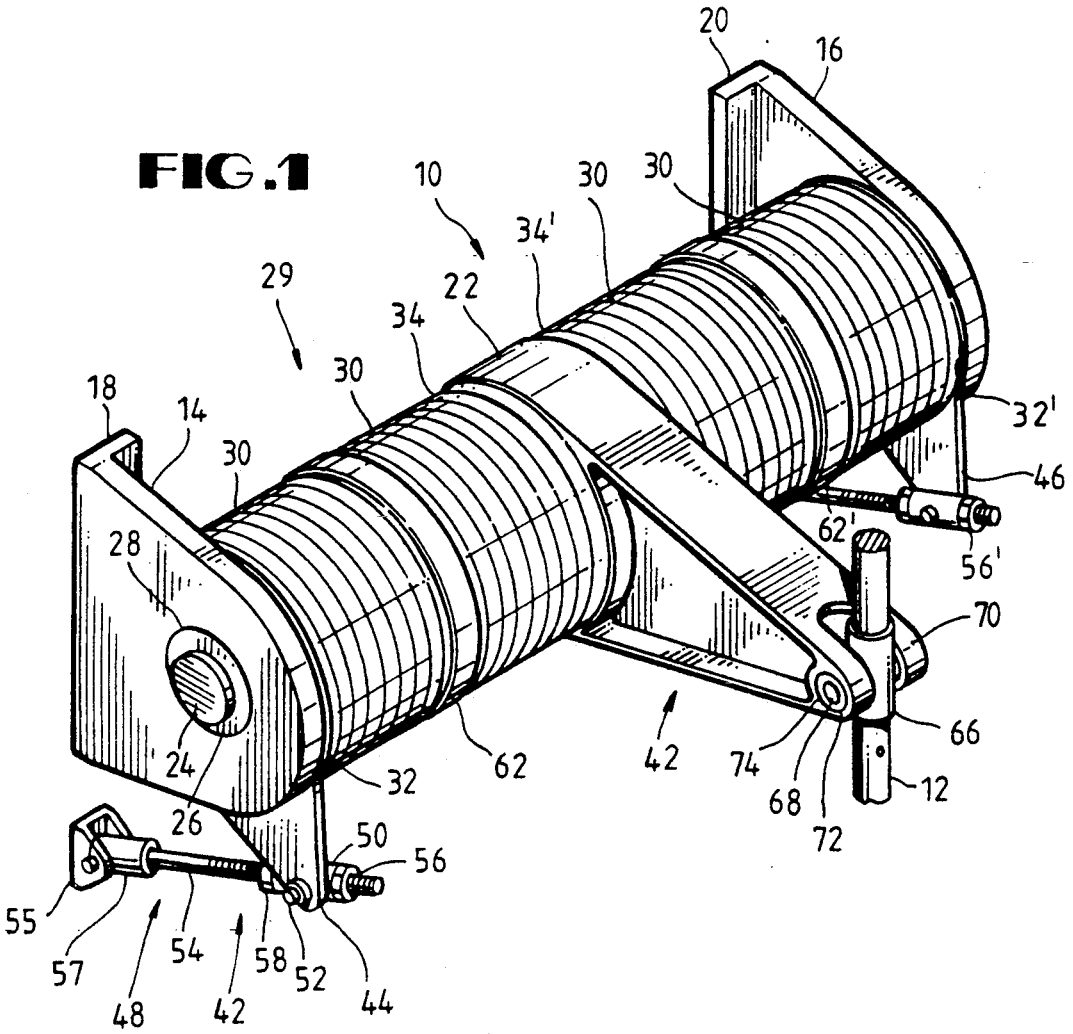
FIG. 1 illustrates a perspective view of a first embodiment of a riser tensioner system utilizing metallic coil springs as an energy storage medium.

While the system is susceptible to various modifications and alternative forms, specific embodiments thereof have been shown by way of example in the drawings and will herein be described in detail. It should be understood, however, that this specification is not intended to limit the invention to the particular forms disclosed herein, but on the contrary, the intention is to cover all modifications, equivalents, and alternatives falling within the spirit and scope of the invention, as defined by the appended claims.

DESCRIPTION OF THE PREFERRED EMBODIMENTS

Referring now to the drawings and, in particular, to FIG. 1, a perspective view of a riser tensioner system 10 is illustrated. The riser tensioner system 10 is connected to a riser 12 that extends from a subsea wellhead (not shown) to a floating platform (not shown). As is to be expected, the floating platform oscillates relative to the riser in accordance with wave action. The riser tensioner system 10 compensates for this oscillatory movement of the floating platform while supporting the riser 12 and preventing it from collapsing under its own weight.

The riser tensioner system 10 includes a pair of mounting brackets or supports 14, 16, which are attached to the floating platform (not shown) via mounting surfaces 18, 20 by, for example, a threaded bolt connection, welding, riveting, or even integral construction therewith. The riser 12 is connected to the riser tensioner system 10 via a central bracket or support 22 centrally located between the mounting brackets 14, 16.

Preferably, the central support 22 is pivotable relative to the mounting brackets 14, 16 and the riser 12. This pivotal movement of the central support 22 relative to the mounting brackets 14, 16 is effected by a shaft 24 extending between the mounting brackets 14, 16 and through a central bore in the central support 22. Since the shaft 24 is pivotable relative to the mounting brackets 14, 16 some type of bearing arrangement is preferably used to connect the shaft 24 to the mounting brackets 14, 16. Preferably, an elastomeric bearing 26 is positioned between the shaft 24 and each of the mounting brackets 14, 16. A borehole 28 extends through the mounting bracket 14 and has a diameter slightly larger than the diameter of the shaft 24. The bearing 26 is disposed in the annulus formed between the shaft 24 and the bore 28. The mounting bracket 16 is similarly configured and likewise includes a bore 28' and an elastomeric bearing 26' positioned in the bore and about the shaft 24.

It should be appreciated that movement of the platform and the riser tensioner system 10 in a direction parallel to the longitudinal axis of the riser 12 causes the pivotal, central support 22 to rotate and prevent damage to the riser 12. However, for the riser tensioner system 10 to provide an upward vertical force to the riser 12 and prevent the riser 12 from collapsing under its own weight, a connection must be made between the mounting brackets 14, 16 and the central support 22 to urge the central support 22 to pivot in a counterclockwise direction and apply a force to the riser 12 in a generally upward direction. This force is accomplished by a torsion spring 29, which, in this embodiment, takes the form of a plurality of coil springs 30. Preferably, the coil springs 30 are coaxially arranged about the shaft 24 on both sides of the central support 22 with a first end portion 32 connected to the adjustment plates 44, 46 and a second end portion 34 connected to the central support 22. Thus, rotation of the central support 22 relative to the mounting brackets 14, 16 is resisted by the coil springs 30.

In particular, rotation of the central support 22 in a counterclockwise direction, which urges the riser 12 upwards, has a tendency to unwind the coil springs 30. Conversely, rotation of the central support 22 in the clockwise direction, which allows the riser 12 to move in a downward direction, is resisted by a winding of the coil springs 30. It should be appreciated that for the riser tensioner system 10 to properly support the riser 12, an upward force should be applied to the riser 12. In other words, the central support 22 should be urged in the counterclockwise direction, or should resist clockwise rotation that is induced by the weight of the riser 12 on the central support 22. It should be apparent that winding the coil springs 30 resists downward movement of the riser 12 induced by the weight of the riser 12.

Figure 2:
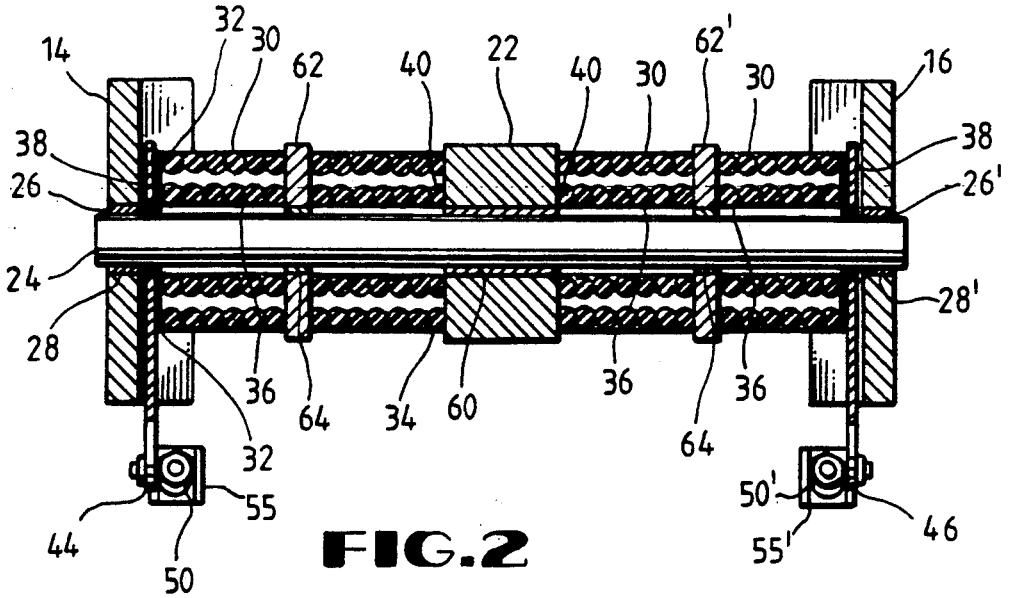
FIG. 2 illustrates a longitudinal cross sectional view of the riser tensioner system of FIG. 1.

To increase the resistance of the springs 30 to clockwise rotation of the central support 22 by the weight of the riser 12, additional springs 36 are disposed within the springs 30. As can be seen in FIG. 2, the springs 36 are disposed inside and coaxial with the springs 30 on both sides of the central support 22. Like the springs 30, the springs 36 have a first end portion 38 connected to the adjustment plates 44, 46 and a second end portion 40 connected to the bracket 22. Thus, the inner springs 36 operate in substantially identical manner to that of the outer springs 30.

To further increase the force exerted by the springs 30, 36 on the central support 22 to resist clockwise rotation of the central support 22 and corresponding downward movement of the riser 12, a pretensioning mechanism 42 is provided. The pretensioning mechanism 42 includes a pair of adjustment plates 44, 46, which are capable of partial rotation about the shaft 24 and extend radially outward adjacent the mounting brackets 14, 16 on opposite ends of the tensioner system 10. The springs 30, 36 have their respective first end portions 32, 38 connected directly to the adjustment plates 44, 46 so as to resist rotational movement of the bracket 22 in a clockwise direction. This resistance to clockwise movement is transferred to a mounting structure via linkage 48.

The linkage 48 consists of a tie-rod sleeve 50 connected to the adjustment plates 44, 46 by a swivel arrangement 52, a tie-rod 54 connected at a first end portion to the tie-rod sleeve 50 and at a second end portion to a pinned bracket 55. The second end portion of the tie rod 54 embodies a larger diameter machined rod section 57 which provides a swivel pin arrangement to permit rotation of the tie rod 54. Preferably, the connection between the tie-rod 54 and tie rod sleeve 50 takes the form of the tie-rod 54 being threaded and extending through a borehole in the sleeve 50 with a pair of nuts 56, 58 threaded on either side of the sleeve 50. The connection between the tie rod 54 second end portion and the pinned bracket 55 takes the form of a pinned swivel joint.

Therefore, to increase the preload of the springs 30, 36, the linkage 48 is adjusted to increase the length of the tie-rod 54, thereby causing further counterclockwise rotation of the springs 30, 36. Counterclockwise rotation of the springs 30, 36, of course, winds the springs 30, 36, increasing the force that they apply to the central support 22 through the plates 44, 46 and linkage 48. Adjustment of the length of the tie-rod 54 is accomplished by counterclockwise rotation of the pair of threaded nuts 56, 58.

Since the central support 22 has limited rotational capability relative to the shaft 24 and plates 44, 46 during adjustment of the linkage 48, a bearing 60 preferably interconnects the central support 22 with the shaft 24. Preferably, the bearing 60 takes the form an elastomeric bearing.

To increase the longitudinal stability of the springs 30, 36, the springs 30, 36 are preferably divided into a pair of longitudinally stacked springs with a stabilizer 62 connected therebetween. The stabilizer 62 is connected to the shaft 24 via a bearing 64 and, therefore, resists radial displacement of the springs 30, 36 which might otherwise occur if the springs 30, 36 were of a unitary structure extending from the mounting brackets 14, 16 to the central support 22. The stabilizers 62, 62' connected to the springs 30, 36 so that rotation of the central support 22 imparts a force to the mounting brackets 14, 16, causing winding or unwinding of the springs 30, 36.

It should be appreciated that since the central support 22 travels on an arcuate path and the riser 12 is preferably maintained in a vertical position, the connection between the central support 22 and the riser 12 is preferably pivotable. For example, a sleeve 66 extends about and is fixed to the riser 12 with a shaft 68 extending perpendicular to the longitudinal axis of the riser 12. The shaft 68 extends radially outward from the sleeve 66 on substantially opposite sides thereof. The central support 22 includes a bifurcated end portion 70 adapted for receiving the sleeve 66 and riser 12 therein with the shaft 68 extending through a borehole 72 in the bifurcated end portion 70. The borehole 72 is coaxially positioned about the shaft 68 and includes an elastomeric bearing 74 substantially similar to the elastomeric bearing 28 in the mounting brackets 14, 16. The pivotal connection allows the riser 12 to remain in its substantially vertical position despite the rotational position of the central support 22.

Figure 3:
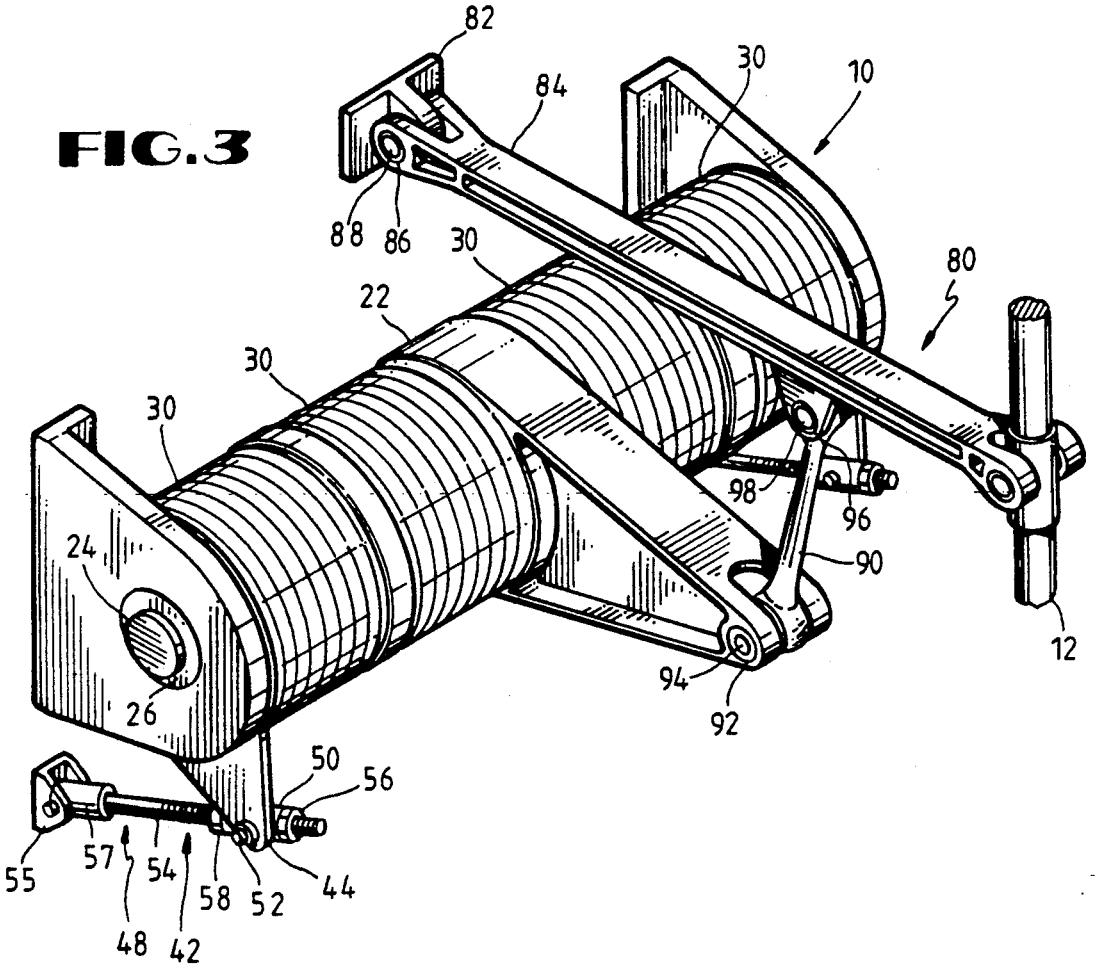
FIG. 3 illustrates a perspective view of a second embodiment of a metallic coil spring riser tensioner system actuating through, an intermediate lever arm arrangement.

FIG. 3 illustrates a second embodiment of the riser tensioner system 10 that is substantially similar to the riser tensioner system 10 illustrated in FIG. 1, differing only in the connection between the central support 22 and the riser 12. Additional mechanical advantage is afforded to the riser tensioner system 10 via a linkage arrangement 80 that is positioned above the riser tensioner system 10 and provides a relatively long lever arm connection between the riser tensioner system 10 and the riser 12.

A mounting bracket 82 is secured to the offshore platform (not shown) in any suitable conventional manner, such as, by threaded bolt connection, welding, riveting, or integral construction therewith. The mounting bracket 82 is pivotally connected to a first end of a lever arm 84 via an elastomeric bearing 86 and shaft 88. The lever arm 84 is connected at its opposite end by a substantially similar pivotal connection to the riser 12.

The central support 22 is pivotally connected to a lower surface of the lever arm 84 via a linkage arm 90. The linkage arm 90 is connected at its first end portion to the bifurcated end portion 70 of the central support 22 via an elastomeric bearing 92 and shaft 94. Likewise, the linkage arm 90 is connected at its second end portion to the lower surface of the lever arm 84 via an elastomeric bearing 96 and shaft 98.

Therefore, it should be appreciated that rotational movement of the central support 22 is translated to rotational movement of the lever arm 84 about the shaft 88. The springs 30, 36 ordinarily urge the central support 22 in a counterclockwise direction, forcing the linkage arm upward against the lever arm 84 and urging it to similarly rotate in a counterclockwise direction about the shaft 88 and apply an upward force to the riser 12 to prevent it from collapsing under its own weight.

Figure 4:
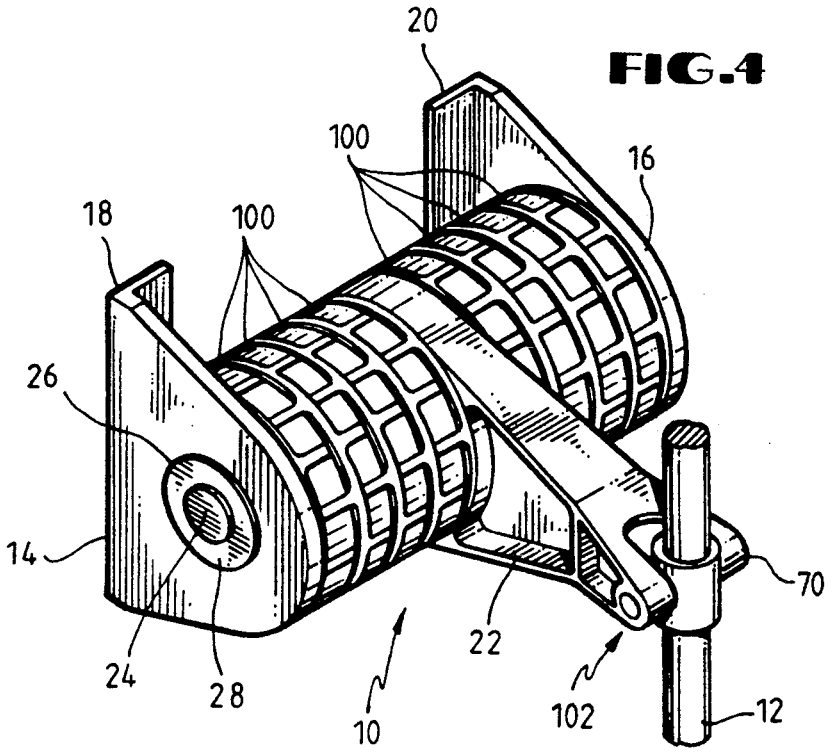
FIG. 4 illustrates a perspective view of a third embodiment of a riser tension system that employs compression loaded elastomeric spring elements as an energy storage medium.
Figure 5:
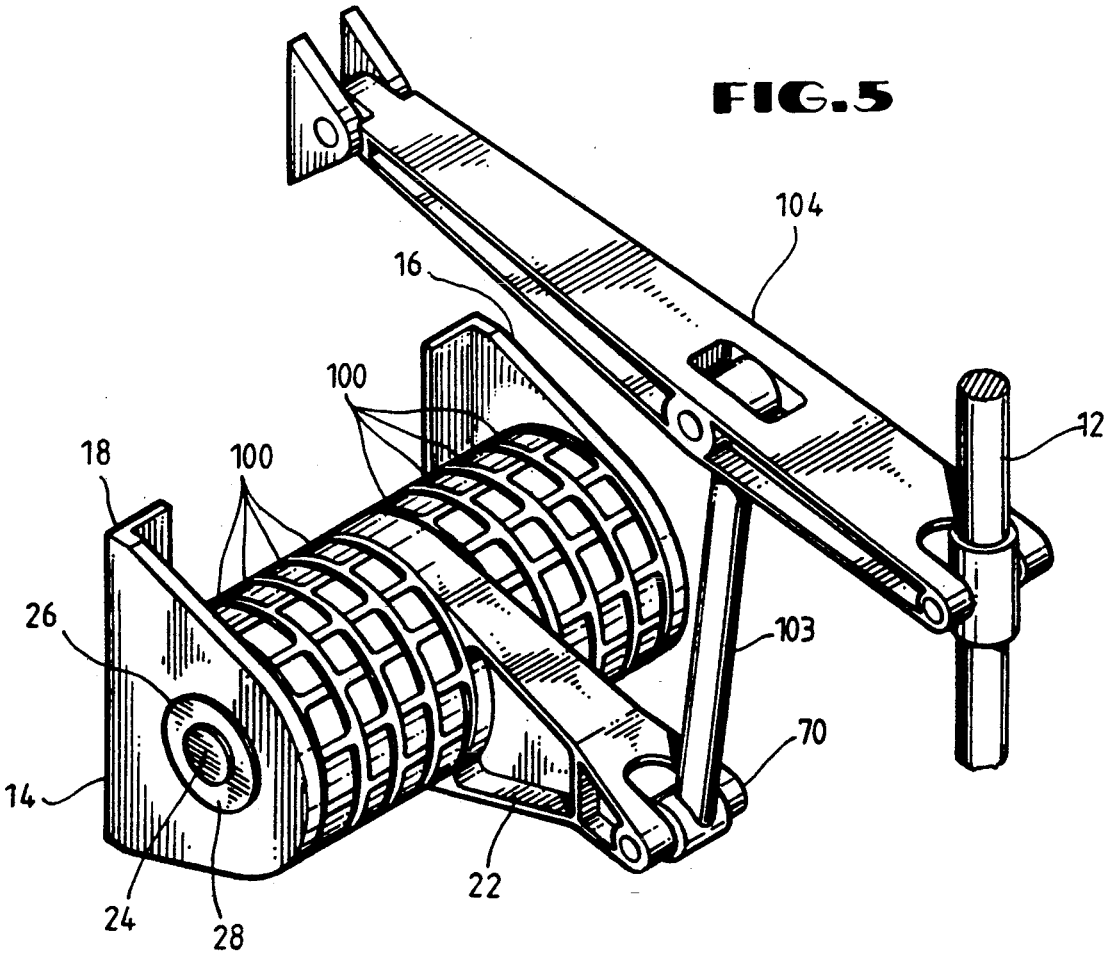
FIG. 5 illustrates a perspective view of fourth embodiment a riser tension system that employs elastomeric spring elements actuating through an intermediate lever arm arrangement.

Referring now to FIGS. 4 and 5, third and fourth embodiments of the riser tensioner system 10 are illustrated. The third and fourth embodiments of the riser tensioner system 10 include mounting brackets 14, 16 connected to an offshore platform (not shown) via mounting surfaces 18, 20. The brackets 14, 16 are spaced apart with a central support 22 located therebetween and connected thereto via a central shaft 24 and a plurality of elastomeric springs 100 symmetrically arranged about the central support 22 between the mounting brackets 14, 16. Like the first and second embodiments of the riser tensioner system 10, the third and fourth embodiments of the riser tensioner system 10 have the shaft 24 pivotally connected to the mounting brackets 14, 16 via an elastomeric bearing 28 located within a borehole 26 of each of the mounting brackets 14, 16.

The basic difference between the third and fourth embodiments is found in the connection between the riser 12 and the central support 22. In this respect, the third and fourth embodiments are substantially similar to the first and second embodiments, respectively.

In the third embodiment, the central support 22 has a bifurcated end portion 70 that extends from the shaft 24 and receives the riser 12 therebetween. The riser 12 is pivotally connected to the bifurcated end portions 70 of the central support 22 via a shaft and elastomeric bearing arrangement 102.

In the fourth embodiment, the central support 22 also has a bifurcated end portion 70 that extends from the shaft 24, but it is connected to an arm 103, which extends to a lever 104. The lever 104 is, in turn, pivotally connected to the riser 12 in much the same fashion as described above in conjunction with the second embodiment shown in FIG. 3.

In the third and fourth embodiments of the riser tensioner system 10, a partial compressive preload is integrally incorporated into each of the elastomeric springs 100. A better appreciation of the operation of this internal preload inherently present in the elastomeric springs 100, may be had by reference to FIGS. 6–12 where a single elastomeric spring 100 is illustrated in greater detail, including the steps for constructing such an elastomeric spring 100.

Figure 6:
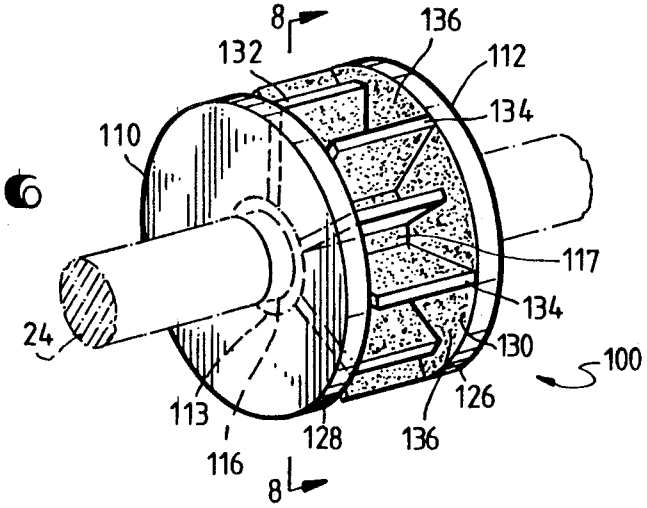
FIG. 6 illustrates a perspective view of a pair of coupling members assembled for molding an elastomeric spring element used in the riser tensioner systems of FIGS. 4 and 5.

Referring now to FIG. 6, an elastomeric spring 100 has a first coupling member 110 and a substantially identical second coupling member 112 mounted on the shaft 24 (shown in phantom) extending through a shaft receiving aperture 116. The shaft receiving aperture 116 is defined by bosses 113, 117 on the coupling members 110, 112. Preferably, the coupling members 110, 112 are free to rotate on the shaft 24 with rotation of the central support 22. However, each of the elastomeric springs is fixedly connected to its neighboring spring so that none are free to rotate relative to the other.

This connection between neighboring springs can take the form of any of a variety of mechanical connections, such as, threaded nut and bolt connection, welding, or, preferably, integral construction therewith. From FIGS. 4 and 5, it should be apparent that the neighboring springs 100 share end portions. That is, the end portion of one spring 100 also forms the end portion of its neighboring spring 100.

Figure 7:
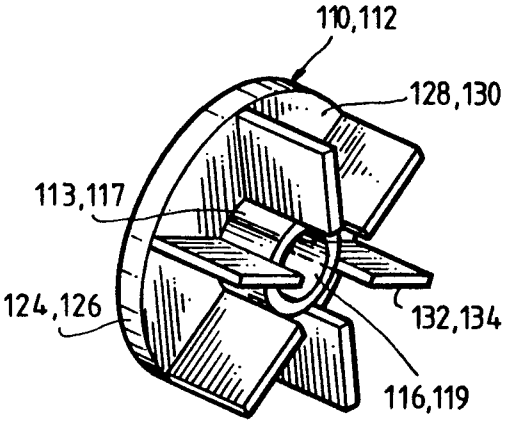
FIG. 7 is an isolated perspective view of a single coupling member of the elastomeric spring element of FIG. 6.

As best seen in FIG. 7, a plurality of fins 132, 134 extend perpendicularly from sides 128, 130 of the coupling members 110, 112 respectively. The fins 132, 134 are aligned radially with respect to the axis of the shaft 24 and are preferably spaced evenly about the circumference of the coupling members 110, 112. The inner edges of the fins 132 are rigidly connected to boss 113, which adds to the stiffness of the fins 132. The boss 117 likewise extends from the side 130, and fins 134 are rigidly connected thereto.

As shown in FIG. 6, the coupling members 110, 112 are positioned in spaced relationship from each other with the sides 128, 130 facing each other and substantially parallel. The fins 132 of the first coupling member 110 are positioned between the adjacent fins 134 of the second coupling member 112. Preferably, the space between the sides 128, 130 of the coupling members 110, 112 is such that a small gap is maintained between the fins 132 and the side 130 and between the fins 134 and side 128 so that no mechanical contact exists between the coupling members 110, 112 except through the elastomeric interface. Likewise, a small gap exists between the bosses 113, 117.

A preloaded elastomeric cushion 136 is located between each pair of adjacent fins 132, 134. These elastomeric cushions 136 are preferably molded into position and bonded to the fins 132, 134 by a process which will now be explained.

Figure 8:
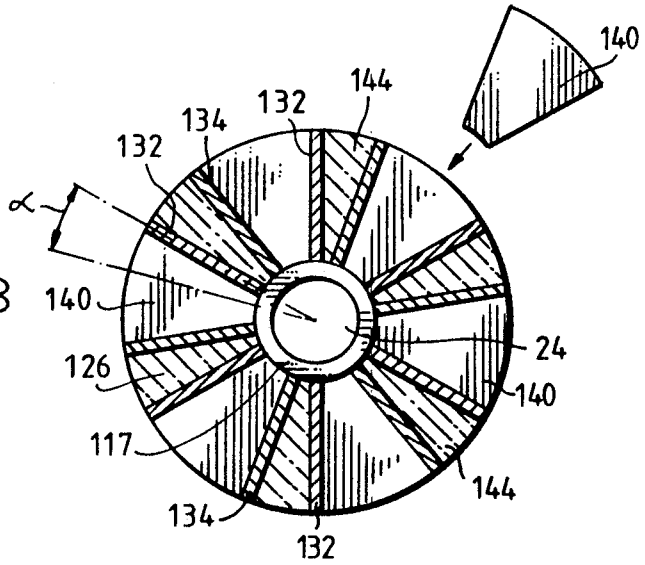
FIG. 8 is a sectional view through the elastomeric spring element of FIG. 6 showing the coupling members being rotated with respect to each other in preparation for a first molding step.

Referring to the cross sectional view of the elastomeric spring 100 shown in FIG. 8, the first and second coupling members 110, 112 are each first placed on the shaft 24 for proper alignment and positioned, as shown in FIG. 8, with the fins 132 of the first coupling member 110 positioned between the adjacent fins 134 of the second coupling member 112. Preferably, the fins 132 of the first coupling member 110 are displaced by an angle ($\alpha$) from a central position between the fins 134 of the second coupling member 112. The amount of rotation is determined by the amount of compression preload desired. If a greater preload is desired in elastomeric cushions 36, the angle ($\alpha$) is increased.

Figure 8A:
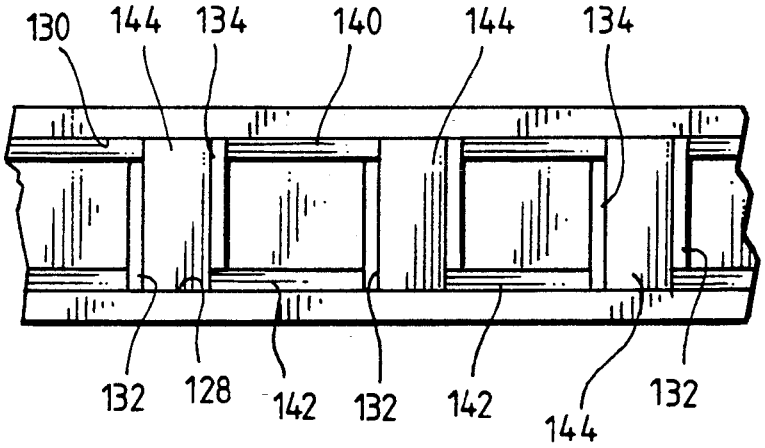
FIG. 8A is a top view of the elastomeric spring element showing the coupling members as positioned in FIG. 8.

Various metal inserts are used to exclude elastomer from certain areas of the elastomeric spring 100 during the molding process. As shown in FIG. 8, the shaft 24 excludes elastomer from seeping through a gap between bosses 113, 117 and into the central area of the elastomeric spring 100. Flat plate inserts 140, 142 are placed in the gaps between the fins 132 and the side 130, and the gaps between the fins 134 and side the 128, respectively, as shown in FIGS. 8 and 8A. The inserts 140, 142 are sized to extend across the wider alternate gaps between the adjacent fins 132, 134. Wedges 144 are then placed in the narrower alternate gaps between the adjacent fins 132, 134. With these inserts 140, 142, 144 in place, elastomer, during the initial molding step, is limited to the wider gaps between the adjacent fins 132, 134 and a space is maintained between the elastomer and the sides 128, 130.

Figure 9:
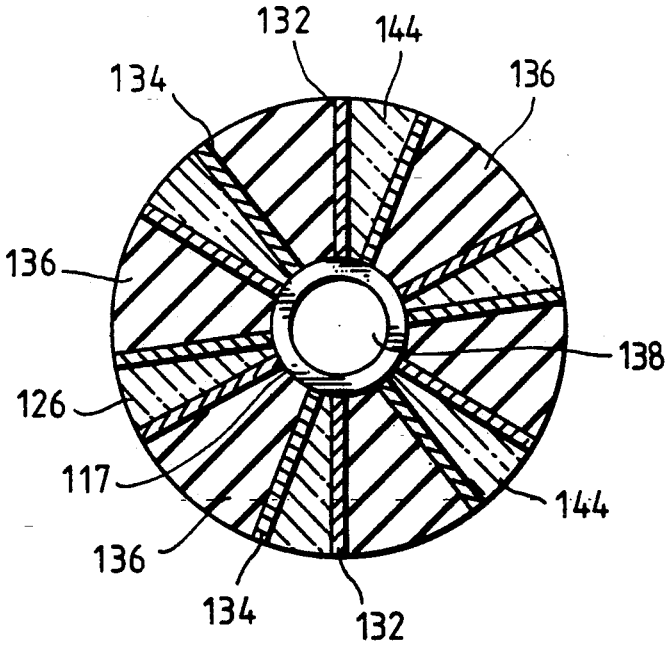
FIG. 9 shows the elastomeric spring element of FIG. 8 after the first molding step.

Elastomeric material is then injected under pressure into the wider gaps between adjacent fins 132, 134 to form the elastomeric cushions 136, as shown in FIG. 9, by well known molding techniques. The elastomeric material contemplated is preferably a natural rubber or a neoprene or nitrile compound. After injection, the cushions 136 are cured and cooled.

Preferably, the elastomeric cushions 136 are bonded directly to the fins 132, 134 to preclude penetration of foreign matter between the fins 132, 134 and the elastomer. This bonding is accomplished as follows. The fins 132, 134 are first carefully cleaned using well-known techniques, including sandblasting and application of trichlorylethylene. A suitable primer and a bonding agent are then applied to the fins 130, 132. When the elastomeric material is introduced, the bonding agent enhances the bond formed between the elastomer and the fins 130, 132 during curing and cooling.

Figure 10:
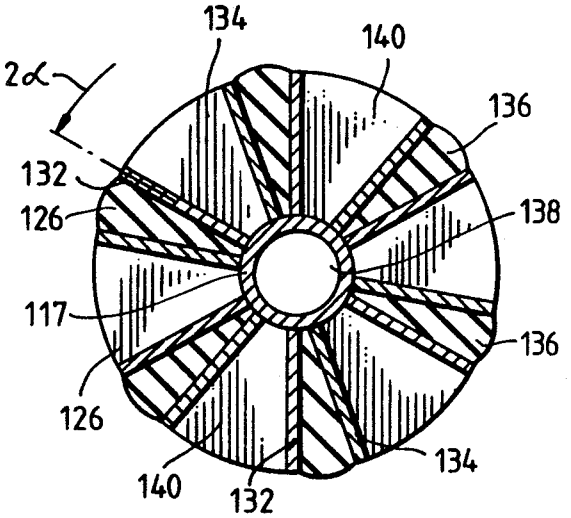
FIG. 10 is a sectional view through the elastomeric spring element showing rotation of the coupling members with respect to each other in the opposite direction to that of FIG. 9 so as to compress the elastomeric material.

Next, the metal inserts 140, 142, 144 are removed, and, as shown in FIG. 10, a torque is applied to rotate the coupling members 110, 112 in the opposite direction with respect to each other by an amount that is preferably twice that of the initial rotation, or ($2\alpha$). This rotation compresses the elastomeric material already in place twice as much as the desired preload, and widens the remaining gaps an amount equal to the wider gaps for the initial molding step. The inserts 140, 142 are then replaced in the gaps between the fins 132 and the side 130 and the gaps between the fins 134 and the side 128, respectively, extending across the wider alternate gaps between the adjacent 132, 134 fins.

Figure 11:
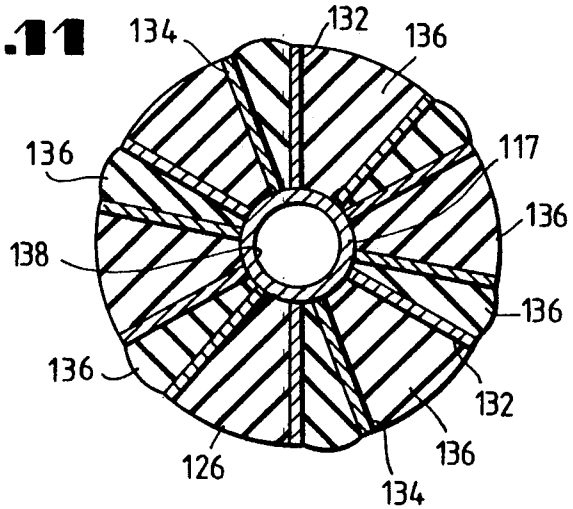
FIG. 11 shows the elastomeric spring element of FIG. 8 after the second molding step.
Figure 12:
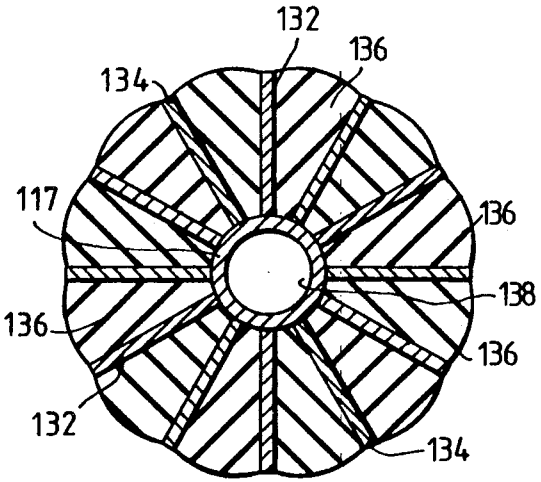
FIG. 12 is a sectional view through the elastomeric spring element showing the position of the coupling members after completion of the molding process.

As shown in FIG. 11, elastomeric material is then injected into the remaining gaps. After cooling and curing, the inserts 140, 142 are removed and the torque is released. This permits the fins 132, 134 to take the final configuration shown in FIG. 12. The fins 132, 134 are now equally spaced around the circumference of the elastomeric spring 100. The compression strain which was applied following the first molding step is now distributed equally in all of the elastomeric cushions 136. Further, the elastomeric cushions 136 are only in contact with the fins 132, 134. The elastomeric material does not touch the sides 128, 130 of the coupling members 110, 112. This configuration provides two advantages. First, no shear forces will be imparted to the elastomeric cushions 136 through the sides 128, 130 as a result of any relative rotational displacement between the coupling members 110, 112. Second, the gaps provide a space into which the elastomeric cushions 136 may bulge under compressive loading.

It may be appreciated that a very large range of spring rates (ratio of deflection to applied load) may be achieved by varying one or more of several parameters. For example, the shape factor (the ratio of loaded area to area that is free to bulge) of the cushions 136 may be varied by varying the number of the fins 132, 134 or the width or height of the fins 132, 134 to achieve the desired spring rate. Further, a relatively hard or relatively soft elastomer may be chosen.

The amount of preload applied during the molding process is determined from the spring rate desired and the fatigue spectrum for the predicted service loadings. It is desirable that the gaps into which the elastomer is injected be of equal size in both the first and second molding steps. This will assure that an equal amount of elastomer is injected between each pair of the fins 132, 134 and that the compressive load will be distributed equally about the circumference of the elastomeric spring 100 upon completion of the molding process. It may be appreciated, however, that unequal amounts of elastomer could be placed in the gaps, and the resulting imbalance of load distribution could be compensated for by varying the type of elastomer used from gap to gap. These unequal amounts of elastomer can be achieved by rotating the coupling members by an amount not equal to ($2\alpha$) or by spacing the fins 132, 134 unevenly about the circumference of the coupling members 110, 112. Further, if the particular application torque will only be applied in one direction or if a different torque loading is contemplated for each direction of rotation, then one set of alternate elastomeric cushions which take up the torque load in one direction need not be uniform in size or composition to the other set of alternate elastomeric cushions which take up the torque in the opposite direction.

Also, although it is preferable that the elastomer be molded into the gaps, those skilled in the art will appreciate that elastomeric cushions can be molded prior to insertion. Attachment to the fins 132, 134 can then be accomplished by prebonding the cushions to a rigid body, such as a plate, which can then be attached to the fins by some mechanical means, such as by bolting. Alternatively, the elastomeric cushions could be premolded and partially cured. The curing process can then be completed in place so that the cushions are bonded to the fins 132, 134.

For economical fabrication, the non-elastomeric hardware, including the coupling members 110, 112 and the fins 132, 134 may be made of a mild steel.

Figure 13:
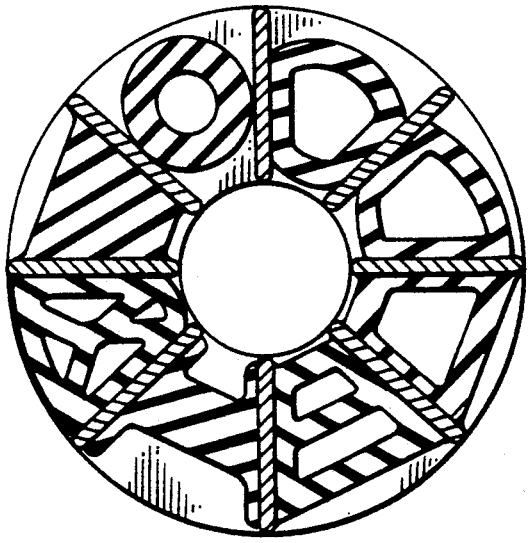
FIG. 13 illustrates a cross sectional end view of the elastomeric spring element of FIG. 6 where the elastomeric portions are shown in a variety of configurations to vary the spring force and achieve differing dynamic characteristics.

FIG. 13 illustrates a variety of configurations that the elastomeric cushions 136 may take to provide a variety of spring rates and spring characteristics, as discussed above.

Additionally, preload of the third and fourth embodiments may be further controlled or enhanced by the addition of the pretensioning mechanism 42 described in conjunction with the first and second embodiments.

We claim:

1. A riser tensioner system adapted for mounting between a floating platform and a riser, and for applying a generally upward force to the riser while allowing limited vertical movement therebetween, comprising:

at least first and second spaced apart supports adapted for being supported relative to said platform in spaced-apart relation;

a shaft coupled to each of said first and second supports and extending therebetween;

a central support having a first end portion coupled to said shaft between said first and second supports and a second end portion adapted for being coupled to said riser;

a torsion spring having a first end portion coupled to one of said first and second supports and a second end portion coupled to said central support whereby said torsion spring urges said central support to rotate about said shaft and force said riser generally upward to support said riser; and pretensioning means for applying a bias to said torsion spring whereby the force applied to the central support and riser is enhanced.

2. A riser tensioner system, as set forth in claim 1, wherein said torsion spring includes a metallic coil spring coaxially positioned about said shaft and having a first end portion coupled to one of said first and second supports and a second end portion coupled to said central support.

3. A riser tensioner system, as set forth in claim 1, wherein said torsion spring includes first and second metallic coil springs coaxially positioned about said shaft and each having a first end portion coupled to a respective one of said first and second supports and a second end portion coupled to said central support.

4. A riser tensioner system, as set forth in claim 3, wherein said torsion spring includes third and fourth metallic coil springs coaxially positioned about said shaft and said first and second coil springs respectively, said third and fourth metallic coil springs each having a first end portion coupled to a respective one of said first and second supports and a second end portion coupled to said central support.

5. A riser tensioner system, as set forth in claim 4, wherein said first, second, third, and fourth metallic coil springs are each formed from a pair of longitudinally stacked metallic coil springs with a stabilizer interconnecting each of said longitudinal pairs of springs.

6. A riser tensioner system, as set forth in claim 5, wherein said stabilizer includes first and second disks, each disk having first and second sides and a central bore extending therebetween, said discs being coaxially positioned about said shaft between the pairs of longitudinally stacked first and third coil springs and the pairs of longitudinally stacked second and fourth coil springs respectively, said first sides of each of said disks being respectively coupled to one of the pairs of said first and third longitudinally stacked coil springs, and said second sides of each of said disks being respectively coupled to the other one of the pairs of said second and fourth longitudinally stacked coil springs.

7. A riser tensioner system, as set forth in claim I, wherein said pretensioning means includes a plate coupled to said shaft and the first: end portion of the spring between said spring and at least one of said first and second supports and being pivotal relative to said first and second supports, linkage coupled between the plate and at least one of said first and second supports, and means for adjusting the length of the linkage whereby the central support and plate are rotated relative to one another to wind and unwind the torsion spring.

8. A riser tensioner system, as set forth in claim 1, wherein said torsion spring includes an elastomeric spring coaxially positioned about said shaft and having a first end portion coupled to one of said first and second supports and a second end portion coupled to said central support.

9. A riser tensioner system, as set forth in claim 1, wherein said torsion spring includes first and second elastomeric springs coaxially positioned about said shaft and each having a first end portion coupled to a respective one of said first and second supports and a second end portion coupled to said central support.

10. A riser tensioner system, as set forth in claim 9, wherein said first and second elastomeric springs each includes a plurality of longitudinally stacked elastomeric springs fixedly coupled together between said first and second supports and said central support respectively.

11. A riser tensioner system, as set forth in claim 10, wherein each of said plurality of longitudinally stacked elastomer springs includes first and second spaced-apart coupling members respectively located at said first and second end portions, a first and second plurality of radial fins extending axially from said first and second coupling members respectively so that each of said first and second radial fins have a region that axially overlap, and a plurality of elastomeric cushions bonded between said first and second radial fins in said overlap region.

12. A riser tensioner system adapted for mounting between a floating platform and a riser, and for applying a generally upward force to the riser while allowing limited vertical movement therebetween, comprising:

first and second spaced apart supports adapted for being supported relative to said platform in spaced-apart relation;

a shaft coupled to each of said first and second supports and extending therebetween;

a central support having a first end portion coupled to said shaft between said first and second supports and a second end portion adapted for being coupled to said riser;

a metallic coil spring coaxially positioned about said shaft and having a first end portion coupled to one of said first and second supports and a second end portion coupled to said central support whereby said spring urges said central support to rotate about said shaft and force said riser generally upward to support said riser; and pretensioning means for applying a bias to said spring whereby the force applied to the central support and riser is enhanced.

13. A riser tensioner system, as set forth in claim 12, wherein said spring includes first and second metallic coil springs coaxially positioned about said shaft and each having a first end portion coupled to a respective one of said first and second supports and a second end portion coupled to said central support.

14. A riser tensioner system, as set forth in claim 13, wherein said spring includes third and fourth metallic coil springs coaxially positioned about said shaft and said first and second coil springs respectively, said third and fourth metallic coil springs each having a first end portion coupled to a respective one of said first and second supports and a second end portion coupled to said central support.

15. A riser tensioner system, as set forth in claim 14, wherein said first, second, third, and fourth metallic coil springs are each formed from a pair of longitudinally stacked metallic coil springs with a stabilizer interconnecting each of said longitudinal pairs of springs.

16. A riser tensioner system, as set forth in claim 15, wherein said stabilizer includes first and second disks, each disk having first and second sides and a central bore extending therebetween, said discs being coaxially positioned about said shaft between the pairs of longitudinally stacked first and third coil springs and the pairs of longitudinally stacked second and fourth coil springs respectively, said first sides of each of said disks being respectively coupled to one of the pairs of said first and third longitudinally stacked coil springs, and said second sides of each of said disks being respectively coupled to the other one of the pairs of said second and fourth longitudinally stacked coil springs.

17. A riser tensioner system, as set forth in claim 12, wherein said pretensioning means includes a plate coupled to said shaft and the first end portion of the spring between said spring and said first support and being pivotal relative to said first support, linkage coupled between the plate and the first support, and means for adjusting the length of the linkage whereby the first support and plate are rotated relative to one another to wind and unwind the spring.

18. A riser tensioner system adapted for mounting between a floating platform and a riser, and for applying a generally upward force to the riser while allowing limited vertical movement therebetween, comprising:

first and second spaced apart supports adapted for being supported relative to said platform in spaced-apart relation;

a shaft coupled to each of said first and second supports and extending therebetween;

a central support having a first end portion coupled to said shaft between said first and second supports and a second end portion adapted for being coupled to said riser;

an elastomeric spring coaxially positioned about said shaft and having a first end portion coupled to one of said first and second supports and a second end portion coupled to said central support whereby said spring urges said central support to rotate about said shaft and force said riser generally upward to support said riser; and pretensioning means for applying a bias to said spring whereby the force applied to the central support and riser is enhanced.

19. A riser tensioner system, as set forth in claim 18, wherein said torsion spring includes first and second elastomeric springs coaxially positioned about said shaft and each having a first end portion coupled to a respective one of said first and second supports and a second end portion coupled to said central support.

20. A riser tensioner system, as set forth in claim 19, wherein said first and second elastomeric springs each includes a plurality of longitudinally stacked elastomeric springs fixedly coupled together between said first and second supports and said central support respectively.

21. A riser tensioner system, as set forth in claim 20, wherein each of said plurality of longitudinally stacked elastomer springs includes first and second spaced-apart coupling members respectively located at said first and second end portions, a first and second plurality of radial fins extending axially from said first and second coupling members respectively so that each of said first and second radial fins have a region that axially overlap, and a plurality of elastomeric cushions bonded between said first and second radial fins in said overlap region.

22. A method for supporting a riser relative to a floating platform while allowing limited vertical movement therebetween, comprising the steps of:

positioning a torsional spring coaxially about a shaft extending between first and second, spaced-apart supports;

coupling a first end portion of the torsional spring to at least one of the first and second, spaced-apart supports;

coupling a second end portion of the torsional spring to a first end portion of a central support;

coupling a second end portion of the central support to the riser; and applying a pretension bias to the torsion spring whereby the force applied to the central support by the torsion spring is enhanced.

* * * * *

UNITED STATES PATENT AND TRADEMARK OFFICE

CERTIFICATE OF CORRECTION

PATENT NO. : 5,101,905

DATED : April 7, 1992

INVENTOR(S) : Edward J. Arlt, et al.

It is certified that error appears in the above-identified patent and that said Letters Patent is hereby corrected as shown below:

Fig. 7, delete element "124,126" and substitute --128,130-- therefore.

Fig. 8, delete element "126" and substitute --144-- therefore.

Fig. 9, delete element "126" and substitute --144-- therefore.

Fig. 10, delete upper element "126" and substitute --136-- therefore.

Fig. 10, delete bottom element "126" and substitute --140-- therefore.

Fig. 11, delete element "126" and substitute --136-- therefore.

Column 8, line 39, delete element "36" and substitute --136-- therefore.

Column 8, line 47, delete the words "side the" and substitute --the side-- therefore.

Signed and Sealed this

Thirtieth Day of November, 1993

Bruce Lehman

*Attest:*

BRUCE LEHMAN

*Attesting Officer*

*Commissioner of Patents and Trademarks*